US005555875A

United States Patent [19]

Martin et al.

[11] Patent Number: 5,555,875

[45] Date of Patent: Sep. 17, 1996

[54] HANDLE RISER FOR AN ARCHERY BOW

[75] Inventors: Terry G. Martin; Raymond Bray, both of Walla Walla, Wash.

[73] Assignee: Martin Archery Inc., Walla Walla, Wash.

[21] Appl. No.: 323,268

[22] Filed: Oct. 13, 1994

[51] Int. Cl.[6] ..... F41B 5/22

[52] U.S. Cl. ..... 124/44.5; 124/24.1; 124/88

[58] Field of Search ..... 124/23.1, 24.1, 124/25.6, 44.5, 86, 88

[56] References Cited

U.S. PATENT DOCUMENTS

| | | | |
|---|---|---|---|
| 2,664,078 | 12/1953 | Irwin . | |
| 2,816,537 | 12/1957 | Irwin . | |
| 2,975,780 | 3/1961 | Fisher . | |
| 3,623,468 | 11/1971 | Crest . | |
| 3,923,035 | 12/1975 | Trotter . | |
| 4,027,645 | 6/1977 | Damron . | |
| 4,146,009 | 3/1979 | Adams . | |
| 4,287,868 | 9/1981 | Schiff | 124/44.5 |
| 4,290,407 | 9/1981 | Damron | 124/44.5 |
| 4,351,311 | 9/1982 | Phares | 124/44.5 |
| 4,378,780 | 4/1983 | Izuta . | |
| 4,579,101 | 4/1986 | Bateman, III | 124/44.5 |
| 4,632,087 | 12/1986 | Cline | 124/44.5 |
| 4,732,133 | 3/1988 | Chatin . | |
| 4,829,974 | 5/1989 | Anderson . | |
| 4,838,237 | 6/1989 | Cliburn | 124/44.5 |
| 5,022,378 | 6/1991 | Rhodehouse et al. | 124/44.5 |
| 5,140,972 | 8/1992 | Fisk | 124/44.5 |
| 5,205,267 | 4/1993 | Burdick | 124/24.1 |
| 5,331,941 | 7/1994 | Schaffer | 124/44.5 |
| 5,394,858 | 3/1995 | Karolian | 124/44.5 |
| 5,400,763 | 3/1995 | Mazza | 124/44.5 |

*Primary Examiner*—John A. Ricci

*Attorney, Agent, or Firm*—Wells, St. John, Roberts, Gregory & Matkin P.S.

[57] ABSTRACT

A handle riser for an archery bow includes a primary shelf portion and a shelf extension portion integrally interconnected with the primary shelf portion. The shelf extension portion is movable relative to the primary shelf portion to infinitely adjust an arrow rest assembly coupled thereto in overdraw positions between a normal arrow rest position and a maximum overdraw position. A recess is formed in the primary shelf portion to allow the arrow rest upon pivoting to recess below a plane corresponding with the top surface of the shelf portion.

21 Claims, 9 Drawing Sheets

80

84
12
90
116
98
108
118
82
114
86
96
100
120
106
92
102
104
94
12

HANDLE RISER FOR AN ARCHERY BOW

TECHNICAL FIELD

This invention relates to archery bows, and more particularly to handle risers for archery bows.

BACKGROUND OF THE INVENTION

The handle riser is the heart of an archery bow. It provides a central location for an archer to hold the bow and for attaching all related and necessary items, such as the bow limbs and bow string, arrow rest, bow sight, etc.

Traditional handle risers have varied significantly in terms of overall configuration, the sight window created by the riser, and the material from which the riser is manufactured. Virtually all handle risers include a handle grip and some type of a shelf portion. Sometimes the arrow is launched directly from the top surface of the shelf portion. More commonly, however, an arrow rest is attached to the handle riser within the sight window. Unless the shelf portion is used as the arrow rest, traditional archery bows utilize a separate, add-on arrow rest to be mounted to the handle riser, typically by a bolt and nut or by adhesive.

Recently, overdraw arrow rests for archery bows have become popular for field and target archery, and for bowhunting. An overdraw arrow rest allows the tip of the arrow to be positioned behind the handle riser, rather than at the true line of draw or normal arrow rest position, when the bow is at full draw. Shooting a shorter arrow increases arrow speed because of the decrease in arrow weight. Faster arrow speed equates to flatter trajectory of the arrow.

Overdraw arrow rests have been made of various sizes to accommodate a variety of arrow lengths. A drawback of such traditional overdraw arrow rests, however, is that the overdraw arrow rest is an accessory that must be specially mounted to the bow, typically by retro-fitting existing arrow rest designs. Furthermore, if a different length of arrow is used, a new size of overdraw arrow rest must typically be installed on the handle riser.

In traditional handle riser designs, the arrow rest is always an afterthought. Newly manufactured archery bows have traditionally required installation of a separate arrow rest. Therefore, the archer purchasing a new bow must decide the type, size, and style of arrow rest for the bow. An arrow rest can add significantly to the overall cost of the bow. In addition, many archers lack sufficient knowledge as to the type of arrow rest (e.g., a shoot-around rest or shoot-through rest) that should be installed on their bows. Hence, the traditional requirement of retro-fitting an arrow rest on a handle riser adds cost to the purchase of a basic archery bow, and confuses non-sophisticated archers because of the myriads of types and styles of arrow rests offered.

Still another problem with traditional arrow rests is that they commonly give rise to fletch clearance problems. For proper flight, the arrow is desirably released from the bow with the least possible contact between the arrow (including the fletching) and the arrow rest.

Traditional arrow rests typically remain stationary or bias to a slight degree when an arrow is launched. Thus, the arrow must pass through or around the arrow rest. Traditional mounting arrangements between the arrow rest and the handle riser do not allow the arrow rest to recess out of the path of the arrow.

BRIEF DESCRIPTION OF THE DRAWINGS

Preferred embodiments of the invention are described below with reference to the accompanying drawings, which are briefly described below.

FIG. 9 is an exploded isometric view of a shelf extension portion incorporated into the handle riser for an archery bow according to the present invention.

FIG. 13 is an exploded isometric view of a portion of the FIG. 10 embodiment.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

One aspect of the present invention is characterized by a handle riser for an archery bow, comprising:

a main riser portion having an upper end, a lower end, and an intermediate region between the upper end and the lower end;

a primary shelf portion located in the intermediate region of the main riser portion; and a movably adjustable arrow rest assembly integrally incorporated into the shelf portion, the arrow rest being mounted for movement in fore and aft directions relative to the main riser portion between a normal arrow rest position and overdraw arrow rest positions.

Another aspect of the present invention is characterized by a handle riser for an archery bow, comprising:

a main riser portion having an upper end, a lower end, and an intermediate region;

a shelf portion located at the intermediate region of the main riser portion, the shelf having a top shelf surface defining a shelf plane;

an arrow rest assembly pivotally coupled to the shelf portion; and a recess formed in the shelf adjacent the arrow rest assembly, the recess being sized to completely receive the arrow rest assembly below the shelf plane upon full articulation of the arrow rest assembly.

Figure 1:
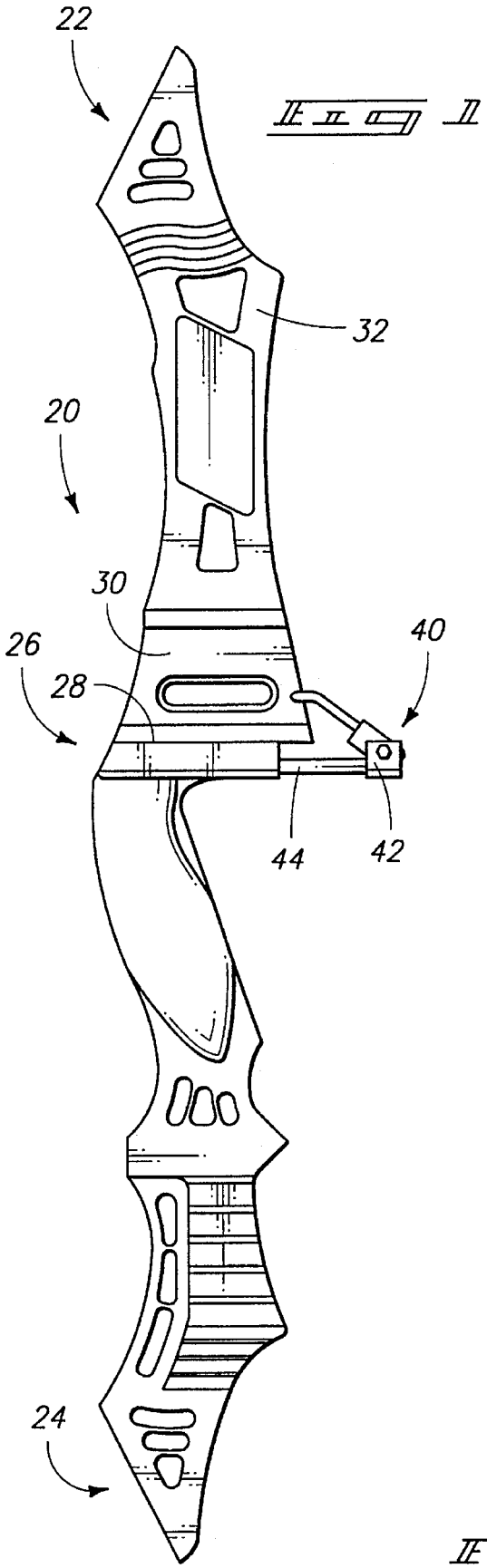
FIG. 1 is a side elevation view of a handle riser for an archery bow according to the present invention.
Figure 2:
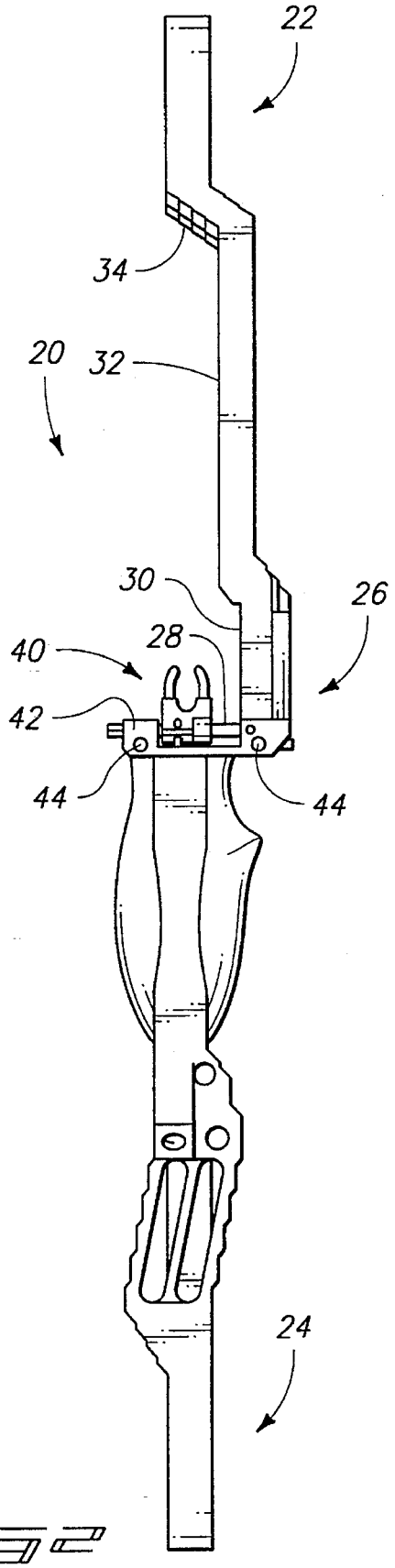
FIG. 2 is a rear elevation view of the handle riser of FIG. 1.
Figure 3:
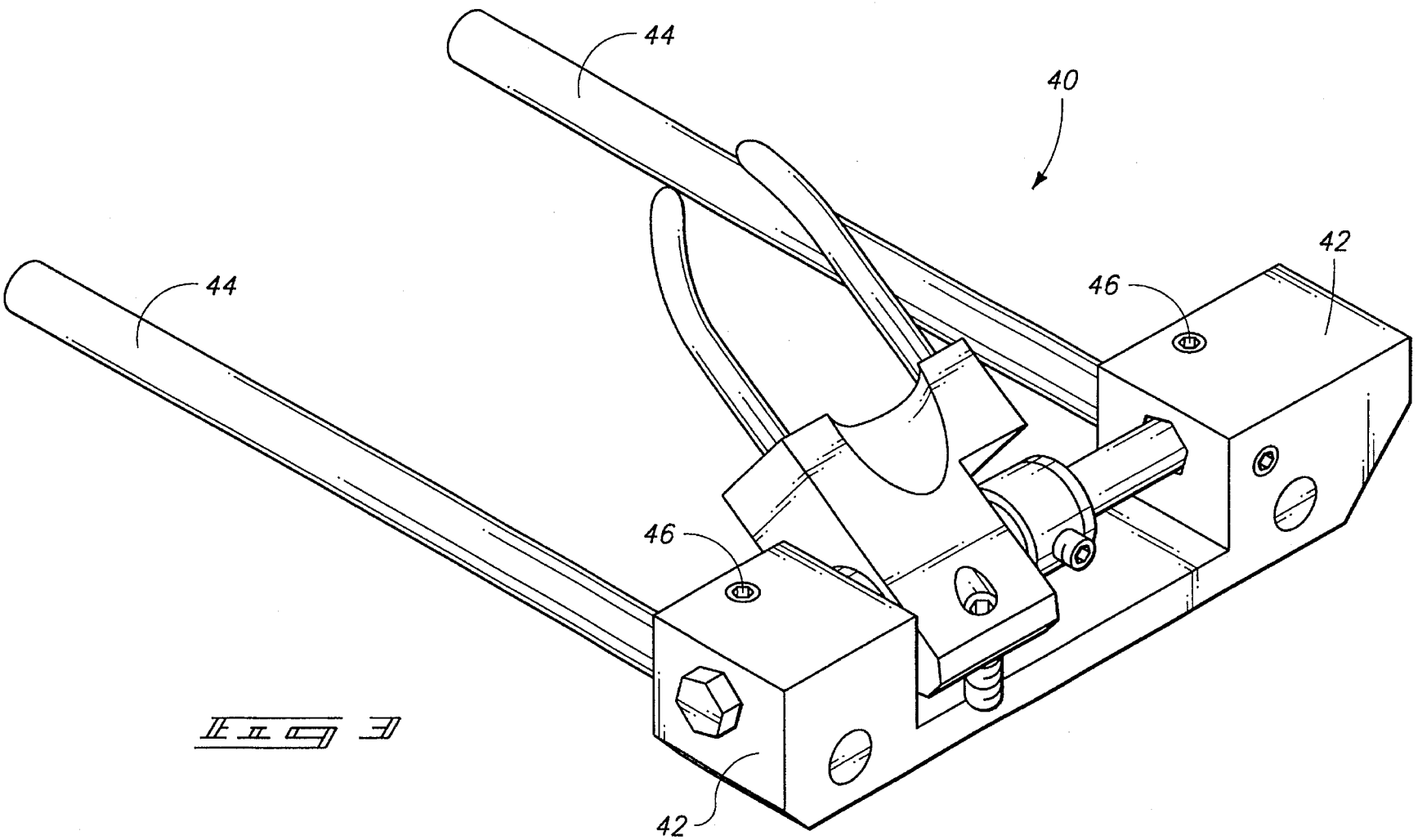
FIG. 3 is a perspective view of a shelf extension portion which forms part of the present invention.

FIGS. 1 and 2 show a main handle riser portion 20 having an upper end 22, a lower end 24, and an intermediate region 26. The handle riser includes a sight window defined by a primary shelf portion 28 within intermediate region 26, a cutaway area 30 of the handle riser, an upper cutaway area 32 of the handle riser, and a transition section 34. Lower cutaway portion 30 is provided to enable the arrow rest to be aligned with the center shot of the handle riser and allow adequate clearance for arrow fletching.

Figure 4:
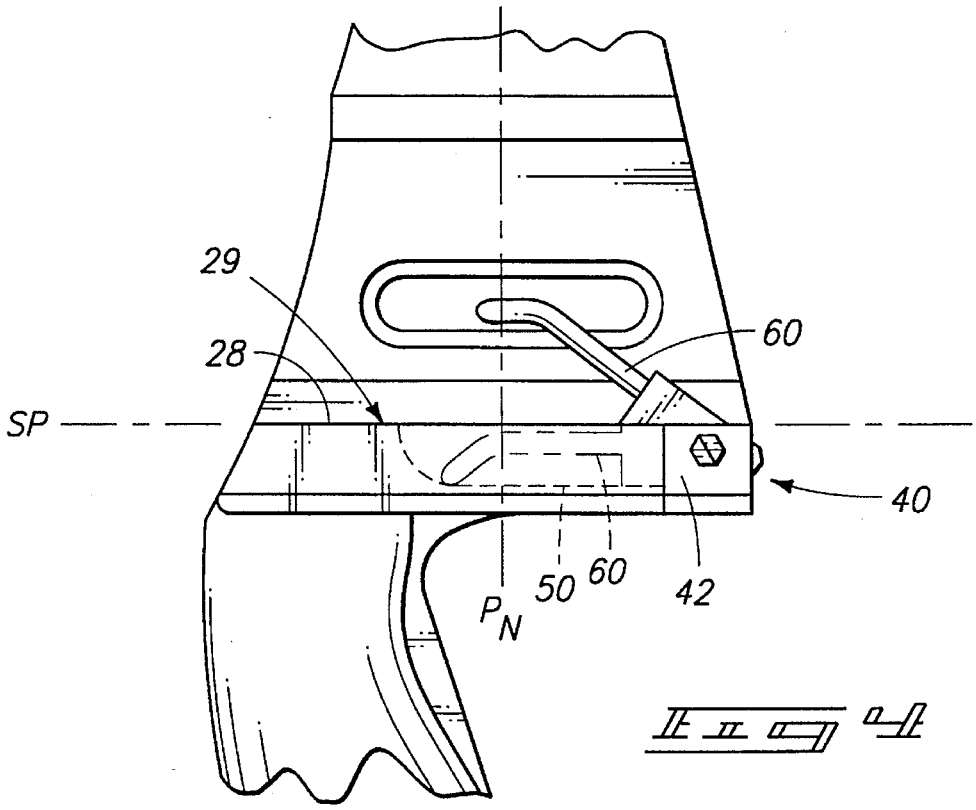
FIG. 4 is a partial side elevation view of the handle riser of FIG. 2 with an integral arrow rest position in the line of true draw.
Figure 5:
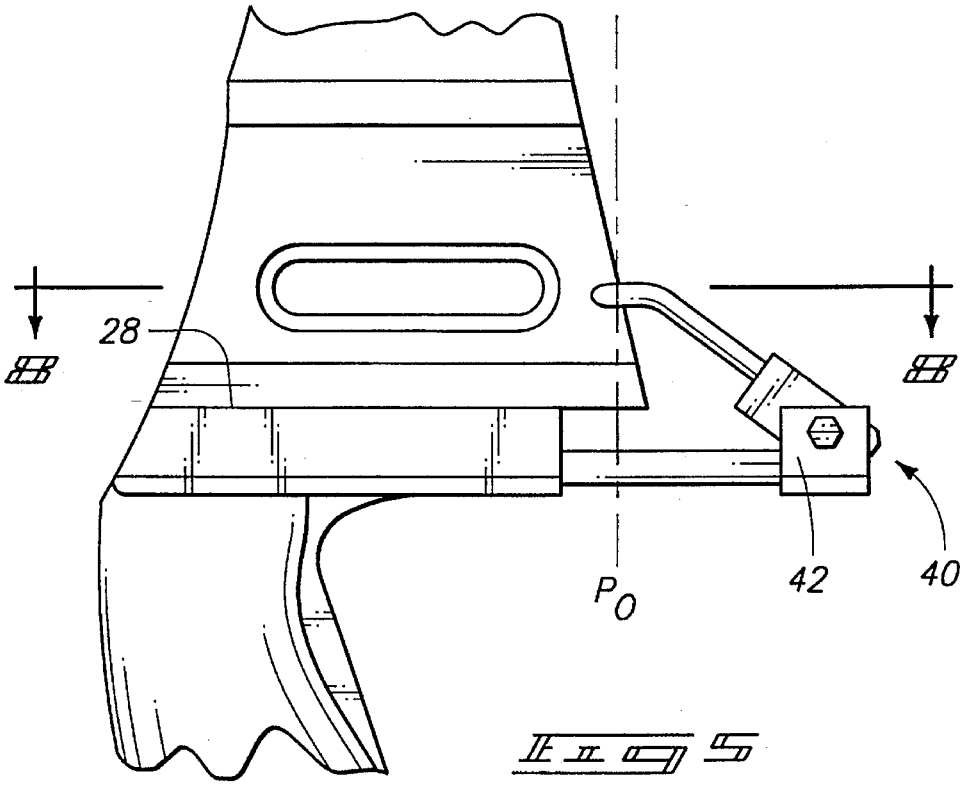
FIG. 5 is a partial side elevation view of the handle riser of FIG. 2 with the arrow rest extended in an overdraw position.

Referring to FIGS. 1–5, an arrow rest assembly 40 is integrally incorporated into the shelf portion 28 of handle riser 20. Arrow rest assembly 40 is mounted for movement in fore and aft directions relative to the main riser portion between a normal arrow rest position $P_N$ (FIG. 4) (i.e., corresponding to the line of true draw) and a maximum rearwardmost overdraw position $P_O$ (FIG. 5). The arrow rest assembly is infinitely adjustable between the extreme forwardmost position $P_N$ and the maximum rearwardmost overdraw position $P_O$. In one embodiment, the distance between the normal arrow rest position $P_N$ and the maximum overdraw position $P_O$ is approximately three inches.

Arrow rest assembly 40, as shown in FIGS. 314 9, comprises a shelf extension portion 42 and a pair of cylindrical rods 44 attached thereto. Respective fasteners 46 in the form of set screws are threadedly received by shelf extension portion 42 engage rods 44 to prevent relative movement between the shelf extension portion 42 and the rods 44.

Primary shelf portion 28 defines a pair of apertures sized to slidably receive the cylindrical rods 44. As such, a sliding male/female interconnecting fit is provided by sliding male/female interconnecting members integrally connecting the arrow rest assembly to the primary shelf portion.

A locking device in the form of a set screw 48 (FIG. 6) is threadedly received by the primary shelf portion and engages one of the rods 44 to lock the position of the arrow rest assembly 40 in a fore/aft position relative to the primary shelf portion 28.

Figure 8:
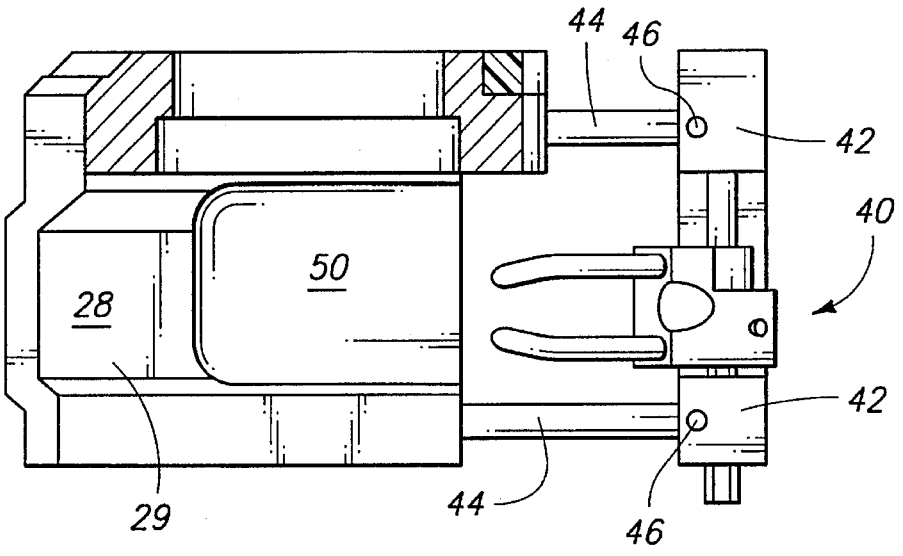
FIG. 8 is a top view, taken along line 8—8 of FIG. 5.

With reference to FIGS. 4 and 8, the primary shelf portion 28 includes a top shelf surface 29 and a recess 50 formed therethrough.

Recess 50 has a lowestmost surface which is below top surface 29 of the primary shelf portion 28. The recess 50 is sized to receive the arrow rest upon pivoting of the arrow rest below the top surface 29 of the primary shelf portion 28. The recess 50 is utilized to receive the arrow rest assembly when the arrow rest assembly 46 extends over the primary shelf portion, as shown in FIG. 4. When the arrow rest assembly 40 is positioned at a rearwardly extending overdraw position, as shown in FIG. 8, a gap is formed between the rods 44, the primary shelf portion 28, and the shelf extension portion 42. This gap is sized to receive the arrow rest to minimize contact between the arrow rest and the arrow being launched.

Figure 6:
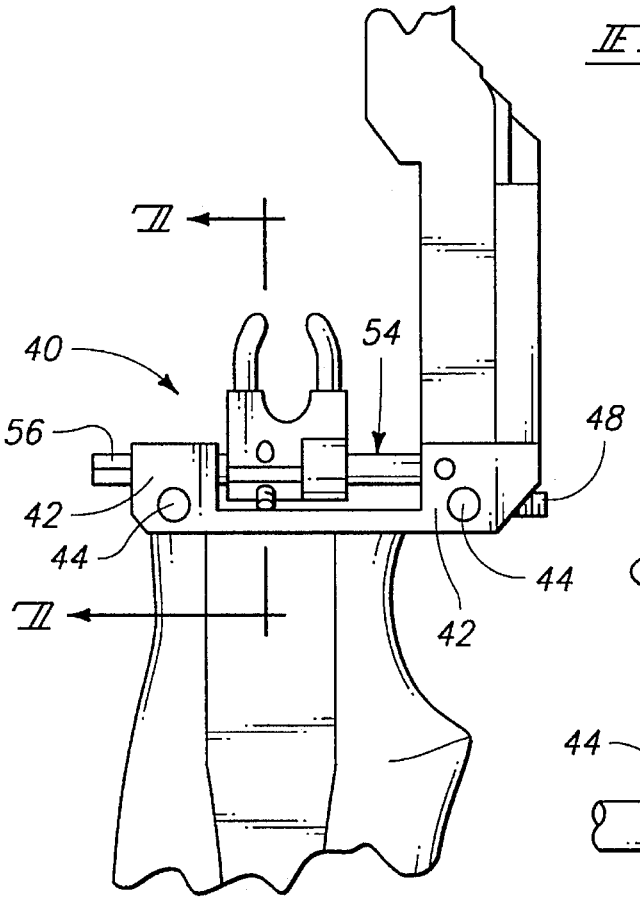
FIG. 6 is a partial enlarged rear view of the handle riser of FIG. 2.
Figure 7:
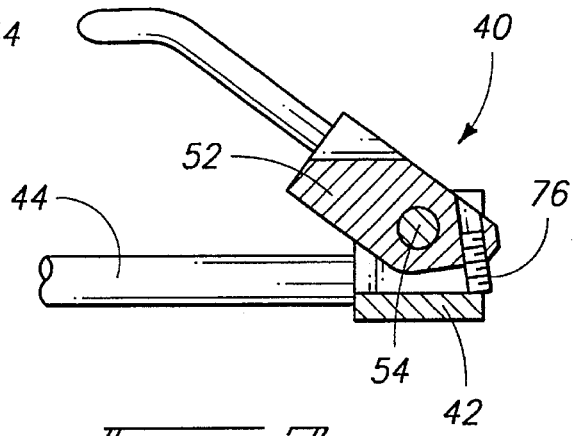
FIG. 7 is a partial side sectional view taken along line 7—7 of FIG. 6.

FIG. 7 shows the details of the arrow rest assembly 40, which includes a rotatable base 52 coupled to a transverse support member 54. The transverse support member includes an end 56 having a hexagonal cross-sectional shape which is received by a corresponding aperture 31 (FIG. 9) in the shelf extension portion 42. As such, the transverse support member 54 is slidable from side to side (as shown in FIG. 6) to position the arrow rest assembly to coincide with the center shot of the handle riser portion. However, the hexagonal end prevents the transverse support member from rotating relative to the arrow rest assembly. A fastener 58 in the form of a set screw is threadedly received by the shelf extension portion 42 and engages the transverse support member 54 to lock the arrow rest assembly in the appropriate center shot position.

Further and with reference to FIG. 9, the arrow rest assembly 40 further comprises a pair of arrow support arms 60 coupled to the rotatable base 52 and secured in position by appropriate set screws 62 (only one shown) threadedly received by the rotatable base 52. A first spacer 64 is positioned between the rotatable base 52 and one side of the shelf extension portion 42. A second spacer 66 is positioned between the rotatable base 52 and the opposite side of the shelf extension portion. The second spacer 66 is secured in place on the transverse support member by means of a keeper or snap ring 68 which is received by a groove 70 formed in the transverse support member 54.

A coil spring 72 provides a biasing force which maintains the arrow rest assembly 42 in an upwardly biased position to support an arrow to be launched. The coil spring includes opposed ends which are received by respective apertures (not shown) in the rotatable base portion 52 and the second spacer 66. The tension of the coil spring can be adjusted by rotating the second spacer 66 relative to the transverse support member 54 and locking the second spacer 66 in relative position on the transverse support member by means of a set screw 74.

The extreme upwardly biased position of the arrow rest assembly 40 can be adjusted by means of another set screw 76 which is threadedly received by the base block 52. The set screw 76 engages the shelf extension portion 42 (FIG. 7) to limit the pivoting movement of the arrow rest assembly 40.

Figure 11:
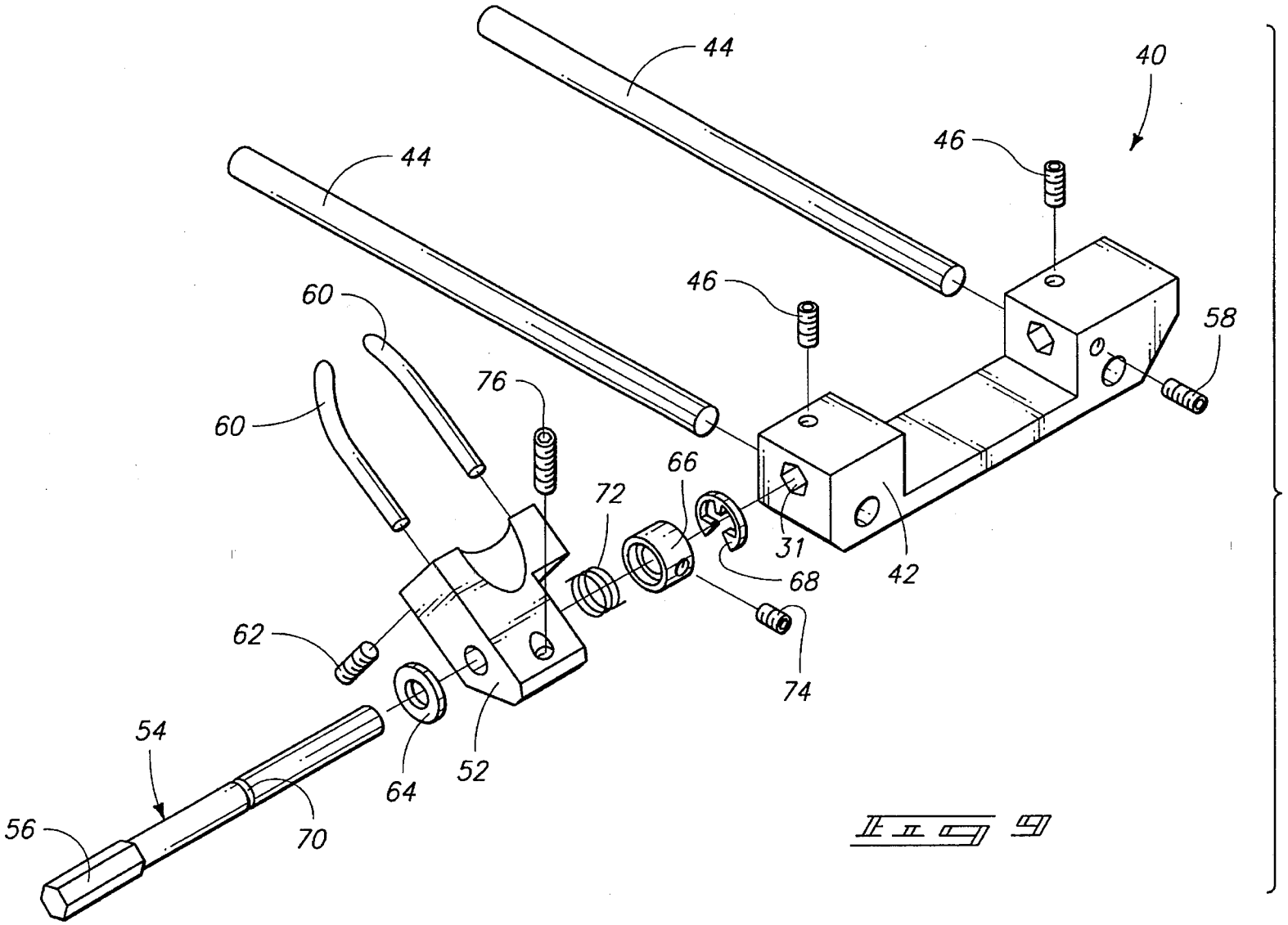
FIG. 11 is a rear view of the embodiment of FIG. 10.
Figure 10:
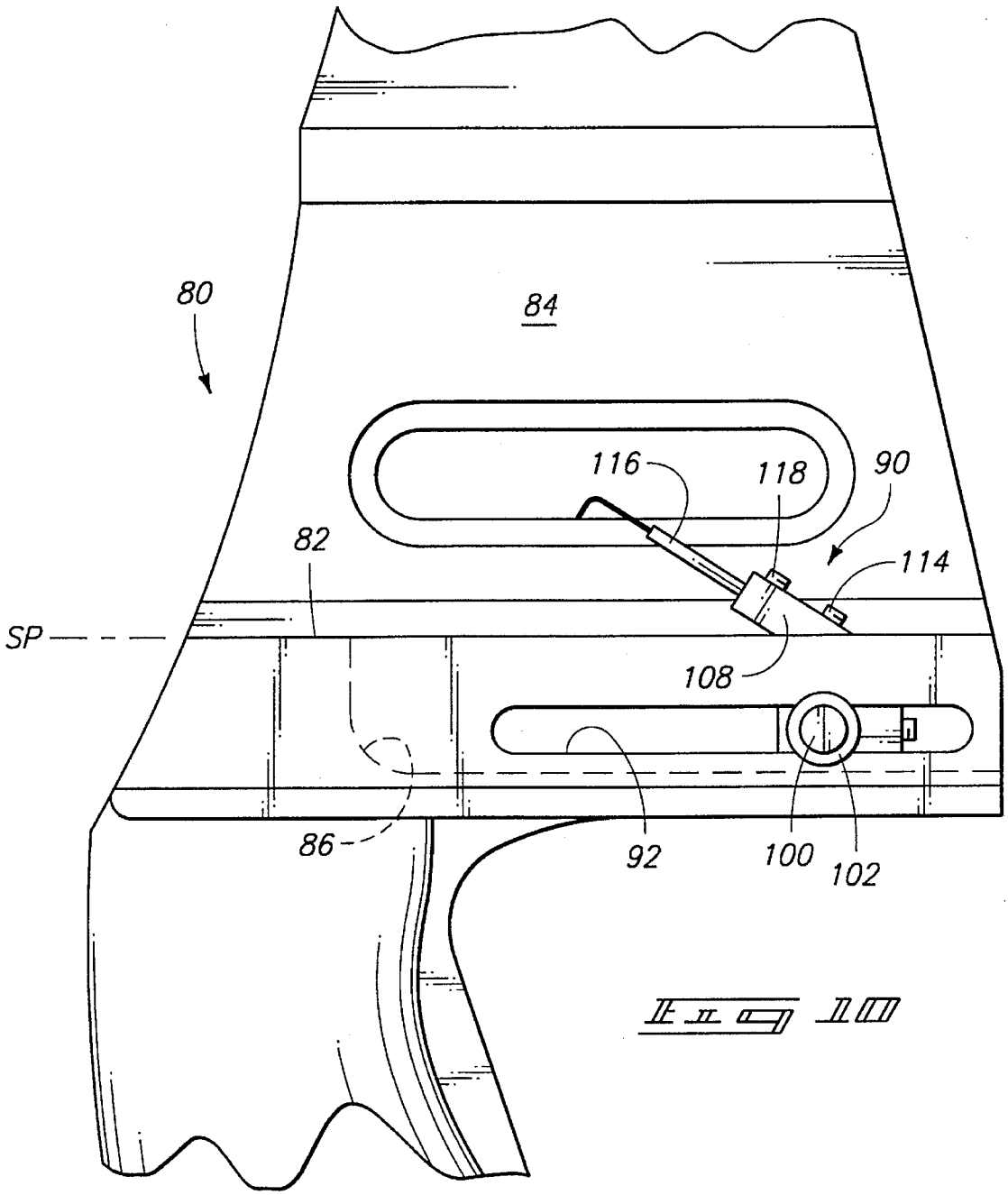
FIG. 10 is an enlarged, partial side elevation view of an alternate embodiment of the present invention.
Figure 11:
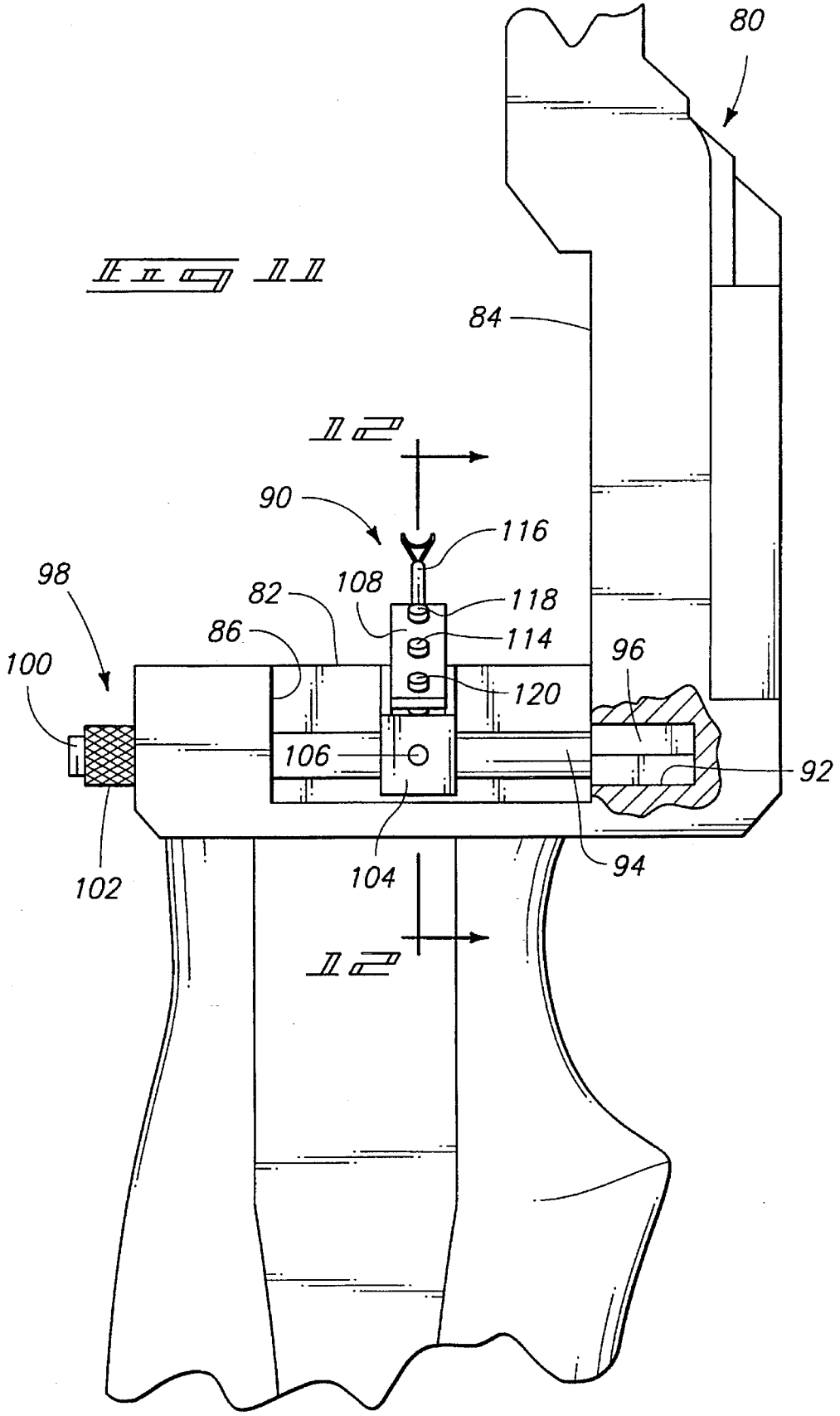
Figure 12:
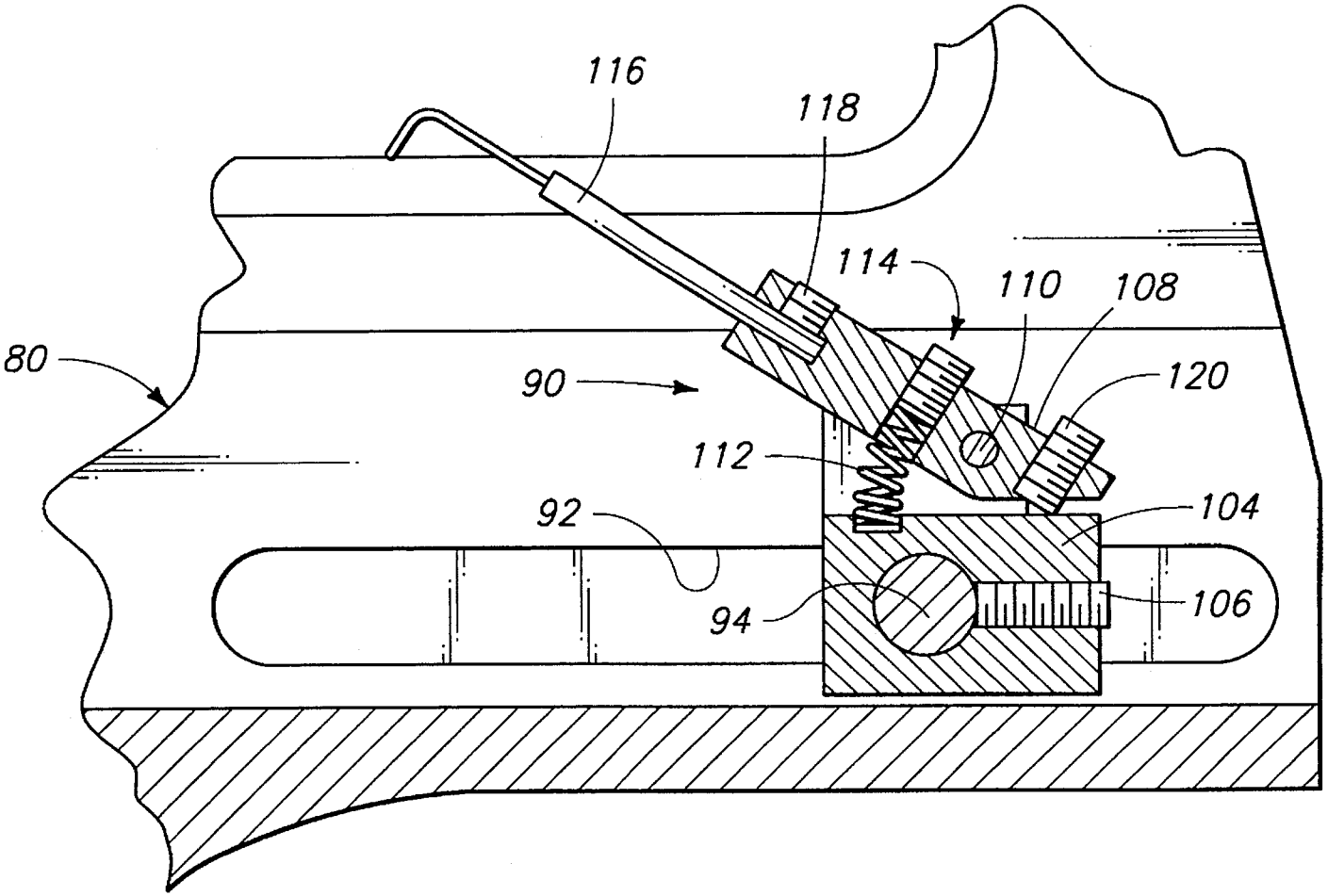
FIG. 12 is a partial sectional side elevation view taken along the line 12—12 of FIG. 11.
Figure 11:
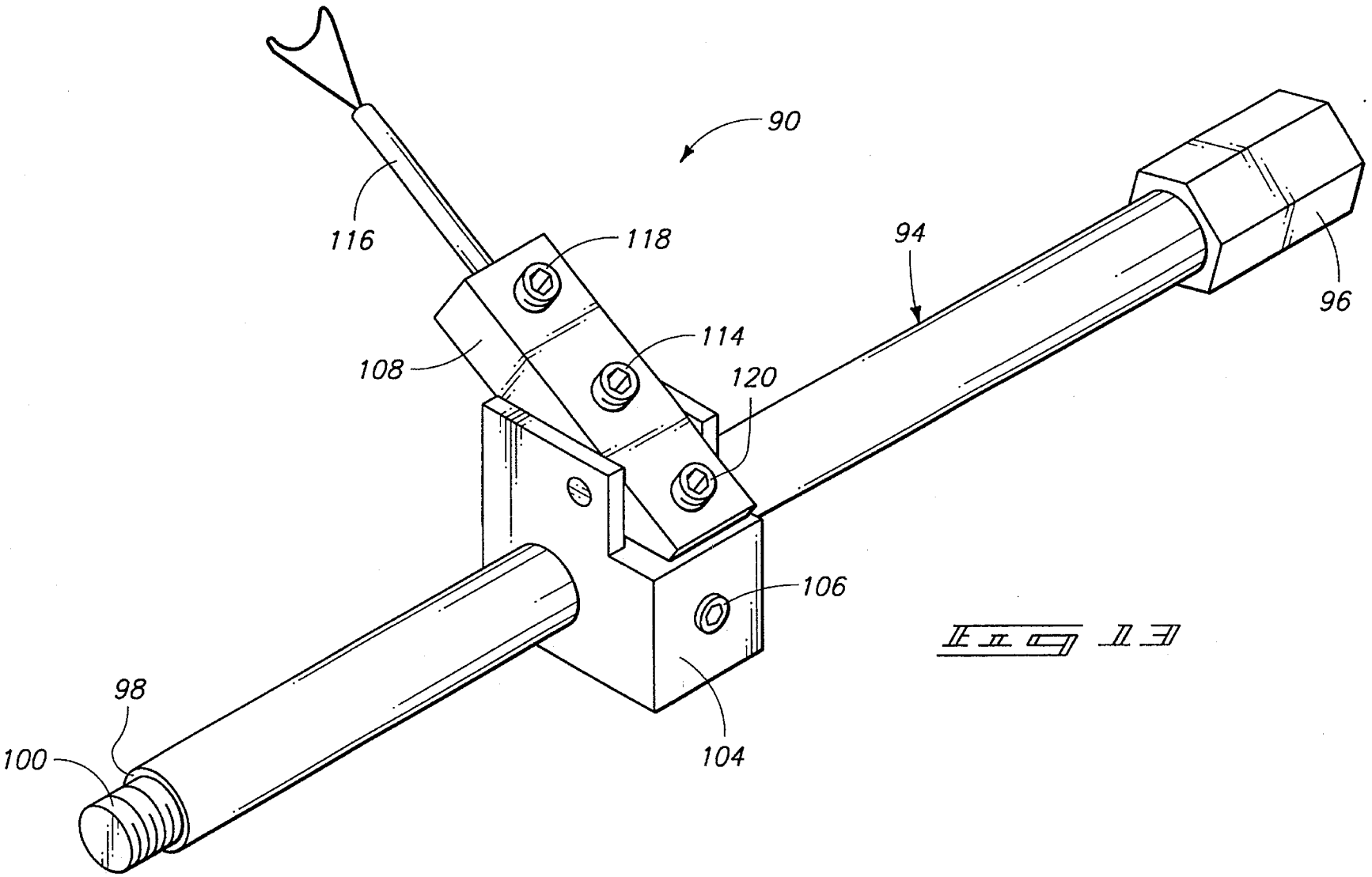

FIGS. 10–12 show another embodiment of the present invention. This embodiment includes a main handle riser portion 80 having a shelf portion 82 which forms the lower end of a sight window. A cutaway wall 84 forms a side of the sight window and is positioned so that an arrow rest assembly 90 can be positioned according to the center shot of the archery bow. The shelf portion 82 includes a recess 86 formed therein. The recess 86 provides an area within which the arrow rest assembly 90 is mounted. In addition, the recess 86 provides a location for the arrow rest to pivot and recess below a shelf plane SP corresponding to the top surface of the shelf 82.

The main riser portion 80 further defines a pair of opposed slots 92 (only one shown in FIG. 10) in which a transverse support member 94 is mounted. The transverse support member includes a hexagonal end 96 which rides in one of the slots to prevent the transverse support member from rotating. Opposite the hexagonal end 96 is an abutment end 98 (FIG. 11) having a threaded portion 100 which is inserted through one of the slots and secured in place by means of a locking nut 102. Preferably, the nut has a knurled surface to facilitate adjustment of the arrow rest assembly. Accordingly, the arrow rest assembly can be moved between an extreme forward position and an extreme rearward position, with the arrow rest assembly being infinitely variably adjustable between those two extremes.

FIG. 12 shows more details of the arrow rest components used in the embodiment of FIGS. 10–12. The arrow rest includes a stationary block 104 suspended by the transverse support member 94. A fastener in the form of a set screw 106 secures the stationary block in position relative to the transverse support member 94. The set screw 106 may be loosened so that the arrow rest assembly can slide along the transverse support member 94 to position the arrow rest assembly 90 to correspond with the center shot position of the archery bow.

A pivoting base member 108 is rotatably coupled to a shaft 110 mounted to stationary block 104. A coil spring 112 is positioned between the pivoting member 108 and the stationary block 104 to bias the arrow rest assembly 90 in an upward position. A tension adjustment screw 114 is threadably received by the pivoting member 108 to adjust the tension of the coil spring 112 and thus the biasing force exerted upon the pivoting member 108. An arrow rest support arm 116 is received by a corresponding aperture in the pivoting member 108 and secured in place by means of a set screw 118.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A handle riser for an archery bow, comprising:

a main riser portion having an upper end, a lower end, and an intermediate region between the upper end and the lower end;

the main riser portion including an integral primary shelf portion located in the intermediate region of the main riser portion; and a movably adjustable arrow rest assembly integrally incorporated into the shelf portion, the arrow rest being mounted for movement in fore and aft directions relative to the main riser portion between a normal arrow rest position and overdraw arrow rest positions.

2. A handle riser for an archery bow according to claim 1 wherein the arrow rest assembly is mounted for movement between an extreme forwardmost position corresponding to the normal arrow rest position and a maximum rearwardmost overdraw position.

3. A handle riser for an archery bow according to claim 2 wherein the arrow rest assembly is mounted to be infinitely adjustable between the extreme forwardmost position and the maximum rearwardmost overdraw position.

4. A handle riser for an archery bow according to claim 1 further comprising sliding male/female interconnecting members integrally connecting the arrow rest assembly with the primary shelf portion.

5. A handle riser for an archery bow according to claim 1, further comprising:

a shelf extension portion, the arrow rest assembly being mounted to the shelf extension portion;

a pair of rods coupled to the shelf extension portion; and a pair of apertures formed in the primary shelf portion, the apertures sized to slidably receive the pair of rods to interconnect the shelf extension portion with the primary shelf portion and allow adjustment of the shelf extension portion relative to the primary shelf portion.

6. A handle riser for an archery bow according to claim 1, further comprising:

a shelf extension portion, the arrow rest assembly being mounted to the shelf extension portion;

at least two rods coupled to the shelf extension portion;

a pair of apertures formed in the primary shelf portion, the apertures sized to slidably receive the at least two rods to interconnect the shelf extension portion with the primary shelf portion and allow adjustment of the shelf extension portion relative to the primary shelf portion; and a locking device engaging the primary shelf portion and the at least two rods to secure the rods in position relative to the respective apertures.

7. A handle riser for an archery bow according to claim 1, further comprising:

a shelf extension portion, the arrow rest assembly being mounted to the shelf extension portion;

a pair of rods coupled to the shelf extension portion;

a pair of apertures formed in the primary shelf portion, the apertures sized to slidably receive the pair of rods to interconnect the shelf extension portion with the primary shelf portion and allow adjustment of the shelf extension portion relative to the primary shelf portion;

wherein the arrow rest assembly is mounted for movement between an extreme forwardmost position corresponding to the normal arrow rest position and a maximum rearwardmost overdraw position; and a gap formed between the at least two rods when the arrow rest assembly is in the fully extended overdraw arrow rest position, the gap being sized to receive the arrow rest assembly upon pivoting of the arrow rest.

8. A handle riser for an archery bow according to claim 1, further comprising a channel formed in the primary shelf portion, the arrow rest assembly being movable within channel between an extreme forwardmost position corresponding to the normal arrow rest position and a maximum rearwardmost overdraw position.

9. A handle riser for an archery bow according to claim 1, further comprising:

a channel formed in the primary shelf portion, the arrow rest assembly being mounted for movement within the channel between an extreme forwardmost arrow rest position and a maximum rearwardmost overdraw position;

opposed slots formed in the primary shelf portion on two sides of the channel; and a transverse support member extending between and riding in the opposed slots, the arrow rest assembly being coupled to the transverse support member for allowing the arrow rest assembly to move within the channel between the extreme forwardmost position and the maximum rearwardmost overdraw position.

10. A handle riser for an archery bow according to claim 1 wherein the primary shelf portion includes a top shelf surface, and further comprising a recess formed in the primary shelf portion through the top surface, the recess being sized to receive the arrow rest assembly upon pivoting of the arrow rest assembly below the top shelf surface.

11. A handle riser for an archery bow, comprising:

a main riser portion having an upper end, a lower end, and a central area;

a shelf portion formed in the main riser portion at the central area; and arrow support means integrally incorporated into the shelf portion for supporting an arrow to be launched, the arrow support means being movable in fore and aft directions relative to the main riser portion between a normal arrow rest position and overdraw arrow rest positions.

12. A handle riser for an archery bow according to claim 11 wherein the arrow support means is mounted for movement between an extreme forwardmost position corresponding to the normal arrow rest position and a maximum rearwardmost overdraw position.

13. A handle riser for an archery bow according to claim 12 wherein the arrow support means is mounted to be infinitely adjustable between the extreme forwardmost position and the maximum rearwardmost overdraw position.

14. A handle riser for an archery bow according to claim 11 wherein the arrow support means includes a sliding male/female interconnecting means for integrally connecting the arrow support means with the primary shelf portion.

15. A handle riser for an archery bow according to claim 11, further comprising:

a shelf extension portion, the arrow support means being mounted to the shelf extension portion;

a pair of rods coupled to the shelf extension portion; and a pair of apertures formed in the primary shelf portion, the apertures sized to slidably receive the pair of rods to interconnect the shelf extension portion with the primary shelf portion and allow adjustment of the shelf extension portion relative to the primary shelf portion.

16. A handle riser for an archery bow according to claim 11, further comprising:

a shelf extension portion, the arrow support means being mounted to the shelf extension portion;

at least two rods coupled to the shelf extension portion;

a pair of apertures formed in the primary shelf portion, the apertures sized to slidably receive the at least two rods to interconnect the shelf extension portion with the primary shelf portion and allow adjustment of the shelf extension portion relative to the primary shelf portion; and locking means engaging the primary shelf portion and the at least two rods for securing the rods in position relative to the respective apertures.

17. A handle riser for an archery bow according to claim 11, further comprising:

a shelf extension portion, the arrow support means being mounted to the shelf extension portion;

a pair of rods coupled to the shelf extension portion;

a pair of apertures formed in the primary shelf portion, the apertures sized to slidably receive the pair of rods to interconnect the shelf extension portion with the primary shelf portion and allow adjustment of the shelf extension portion relative to the primary shelf portion;

wherein the arrow support means is mounted for movement between an extreme forwardmost position corresponding to the normal arrow rest position and a maximum rearwardmost overdraw position; and a gap formed between the at least two rods when the arrow support means is in the fully extended overdraw arrow rest position, the gap being sized to receive the arrow support means upon pivoting of the arrow support means.

18. A handle riser for an archery bow according to claim 11, further comprising a channel formed in the primary shelf portion, the arrow support means being movable within the channel between an extreme forwardmost position corresponding to the normal arrow rest position and a maximum rearwardmost overdraw position.

19. A handle riser for an archery bow according to claim 11, further comprising:

a channel formed in the primary shelf portion, the arrow support means being mounted for movement within the channel between an extreme forwardmost arrow rest position and a maximum rearwardmost overdraw position;

opposed slots formed in the primary shelf portion on two sides of the channel; and a transverse support means extending between and riding in the opposed slots for mounting the arrow support means and for allowing the arrow support means to move within the channel between the extreme forwardmost position and the maximum rearwardmost overdraw position.

20. A handle riser for an archery bow according to claim 11 wherein the primary shelf portion includes a top shelf surface, and further comprising a recess formed in the primary shelf portion through the top surface, the recess being sized to receive the arrow support means upon pivoting of the arrow support means below the top shelf surface.

21. A handle riser for an archery bow, comprising:

a main riser portion having an upper end, a lower end, and an intermediate region;

a shelf portion located at the intermediate region of the main riser portion, the shelf having a top shelf surface defining a shelf plane;

an arrow rest assembly pivotally coupled to the shelf portion; and a recess formed in the shelf portion adjacent the arrow rest assembly, the recess being sized to completely receive the arrow rest assembly below the shelf plane upon full downward articulation of the arrow rest assembly.

* * * * *